United States Patent [19]

Niskin

[11] 4,295,675

[45] Oct. 20, 1981

[54] COVER FOR PORT LIGHT

[76] Inventor: Shale J. Niskin, 3415 Chase Ave., Miami Beach, Fla. 33140

[21] Appl. No.: 124,828

[22] Filed: Feb. 26, 1980

[51] Int. Cl.[3] ..... E05C 17/54

[52] U.S. Cl. ..... 292/256.6; 114/177

[58] Field of Search ..... 16/110, 121; 248/205 A; 312/320; 114/177, 178; 292/256, 256.6

[56] References Cited

U.S. PATENT DOCUMENTS

| | | | |
|---|---|---|---|
| 960,926 | 6/1910 | Hoops, Jr. | 114/177 |
| 2,186,450 | 1/1940 | Ducroux | 114/177 |
| 2,436,407 | 2/1948 | Stephens | 292/256.6 X |
| 2,602,198 | 7/1952 | Parker | 114/177 X |
| 3,986,635 | 10/1976 | Niskin | 220/319 |
| 4,089,571 | 5/1978 | Landy | 312/320 |

*Primary Examiner*—Richard E. Moore
*Attorney, Agent, or Firm*—William A. Newton

[57] ABSTRACT

Disclosed is a locking and sealing arrangement for a port light wherein a cover member has a pair of grooves formed therein; a cover mounting member has a groove formed therein; one groove of the cover member contains an O-ring for forming a water tight seal with the cover mounting member; the other groove of the cover member is aligned with the groove of the cover mounting member so as to form a channel, when the cover member is in place; and an elongated, pliable locking member is inserted in the channel to create a locking engagement between the cover member and the cover mounting member.

4 Claims, 2 Drawing Figures

COVER FOR PORT LIGHT

FIELD OF THE INVENTION

The present invention is directed toward covers for port lights or windows of floating vessels.

DESCRIPTION OF THE PRIOR ART

It is a common practice in the design of boats, ships and like floating vessels to have hinged, detachable covers for the windows or port lights of the vessel. Generally, a metal frame is securely mounted around the port light on the inside of the vessel's wall. A cover, normally comprising a glass plate with a metal rim, is hingedly connected along one side to the metal frame mounted around the port light. A rubber gasket lines the metal frame so that a water tight seal is created when the cover is pivoted shut; thereby compressing the gasket to cause a sealing relationship between the metal frame and the metal rim of the cover. Wing nuts are used to compress the gasket further and to maintain the sealing engagement.

This prior art arrangement for covering and sealing a port light has several inherent disadvantages. First, due to the great stresses created by the previously described hinge assembly the frame around the port light must be made of an expensive, noncorrosive metal of substantial structural strength, such as brass, and cannot be made out of inexpensive materials, such as plastic. Secondly, the wing nuts provide sharp projections that have frequently resulted in serious injuries to persons on board, particularly in rough seas when one is likely to be thrown against the cover by the rocking of the boat. Third, the differential pressure of the hinge assembly can permanently deform the gasket to a greater extent adjacent the hinges than compared to portions of the gasket more remote to the hinges; thereby causing water leakage. Also, the metal rim of the cover normally has a relatively sharp flange portion disposed to engage the gasket; which also causes the rapid deterioration of the gasket.

SUMMARY OF THE INVENTION

The present invention is directed toward a locking and sealing arrangement for a port light of a floating vessel. The arrangement comprises a plastic cover member having formed therein a pair of spaced-apart, peripheral grooves, a first groove and a second groove. An O-ring is positioned in the second groove, so as to form a water-tight seal with a plastic cover mounting member. The cover mounting member has formed therein a third groove which is aligned with the second groove of the cover member to form a channel, when the cover member is in place. An elongated and pliable locking member is inserted through an access bore into the channel. The locking member spans the juncture of the cover member and cover mounting member, thereby providing a locking relationship therebetween.

By virtue of this novel invention, a locking and sealing arrangement is created with stresses in the sealing engagement being minimized, thus allowing use of inexpensive materials, such as plastic, and preventing rapid gasket deterioration and deformation. Also, sharp projections are avoided. Hence, the above described problems of the prior art are overcome.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
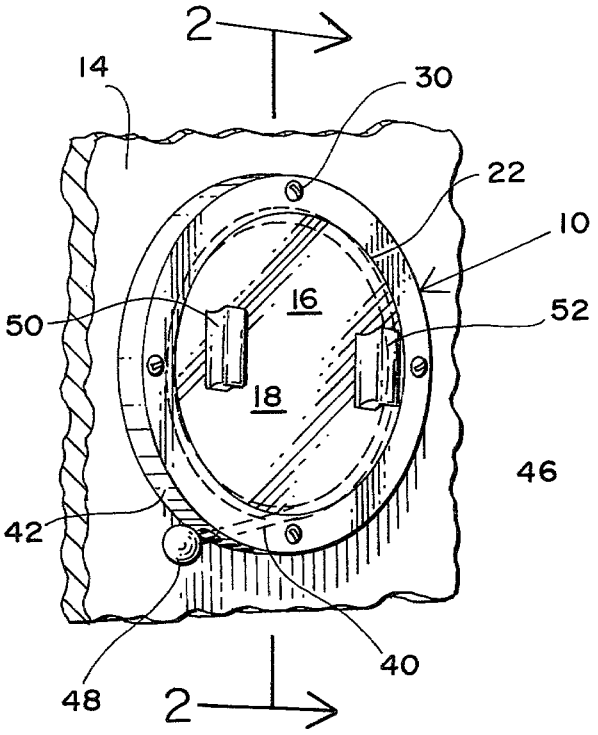
FIG. 1 is a perspective view of the locking and sealing arrangement of the present invention.
Figure 2:
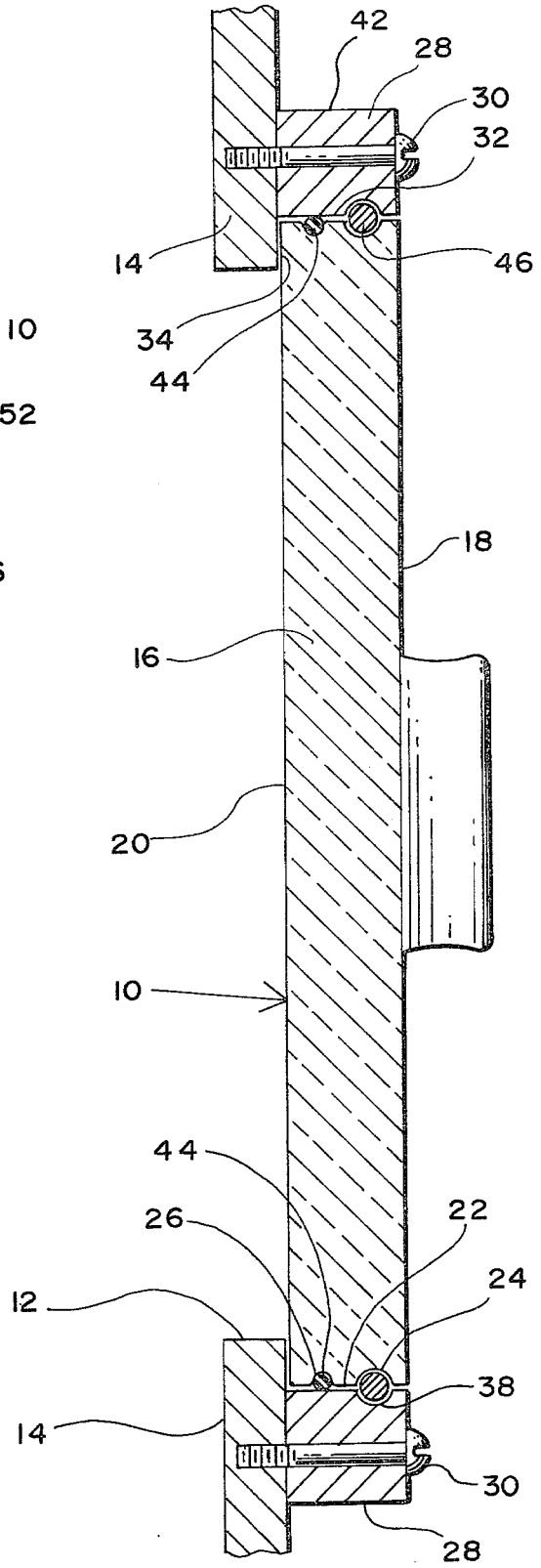
FIG. 2 is a cross-sectional view of the invention taken with respect to section line 2—2 in FIG. 2.

Referring to the drawings, a locking and sealing arrangement 10 is shown for use with a window, or as referred to in the trade, a port light 12 of a floating vessel 14. The port light 12 can be any commonly found vessel opening, generally for viewing and/or ventilation, formed in a wall 14 or like structure of a boat, ship or like floating vessel.

The arrangement 10 comprises a cover member 16, preferably having a pair of opposed flat sides 18 and 20 and an outwardly facing curved rim 22. Although the rim 22 of the illustrative embodiment is circular, the rim 22 can assume a number of configurations, such as those representative of conventional port light configurations. One of the most common configurations is an essentially rectangular shape with rounded corners. As will become apparent hereinafter, corners of the rim 22, if any, must have some curvature; hence, the rim 22 can be described as being continuously curved, even though the degree of curvature might vary along the rim 22. Integrally formed in the rim 22 is a pair of spaced apart, peripheral grooves, first and second grooves 24 and 26, are shown with an arcuate cross-sectional configuration. Any configuration resulting in a groove is acceptable. The cover member 16 is preferably formed of plastic, and if used for viewing, a transparent plastic.

A cover mounting member 28, preferably formed of plastic, is secured to the wall 14 in a conventional manner, such as, for example, by a plurality of bolts 30 and a water sealing adhesive. The cover mounting member 28 has an inwardly facing surface 32 which substantially has the same configuration and dimensions as the rim 22 of the cover member 16. More precisely, the surface 32 will have dimensional tolerances, slightly larger than the rim 22, so as to allow the cover member 16 to slide into the cover mounting member 28, so that member 28 surrounds member 16.

In the preferred embodiment, the inwardly facing surface 32 has a radius greater than the radius of the port light 12, so that a portion of the wall 14 defines a ledge 34. Since the ledge 34 does not provide any sealing, it does not have to completely encircle the port light 12, but it normally does. The inwardly facing surface 32 has a third groove 36 formed therein. When the cover member 16 is positioned inside the cover mounting member 28, with its flat surface 20 in abutting relationship with the ledge 34, the first groove 24 and the third groove 36 will be aligned with each other in opposing relationship. This alignment of the grooves 24 and 26 defines a channel 38 which spans the juncture of the cover member 16 and the cover mounting member 28. Preferably, but not necessarily, the grooves 24 and 26 have cross-sectional configurations of the same size and shape. An access bore 40 extends from the outer surface 42 of the cover mounting member 28 through the same and intersects the third groove 36, and therefore the channel 38, in a relatively tangential manner.

A resilient gasket in the form of a rubber O-ring 44 is snapped into place in the second groove 26 of the rim 22 prior to the placement of the cover member 16 into the inner confines of the cover mounting member 28. The cover member 16 is then forced into the confines of the cover mounting member 28, until the flat surface 20 comes to rest against the ledge 34. The O-ring 44 becomes compressed as the rim 22 slides along the inwardly facing surface 32, so as to provide a water tight seal against moisture and water. At the same time, the first groove 24 and the third groove 36 become aligned to define the channel 38. Generally, the second groove 26 should be positioned to prevent water from reaching the first groove 24, consequently it is positioned adjacent the flat surface 20.

A pliable, elongated locking member 46, whose diameter is approximately equal or slightly less than the dimensions of the channel 38, is threaded through the access bore 40 and is received by the channel 38. Preferably, the locking member 46 has high tensile and shear strength and one example would be a nylon monofilament or steel wire cable. However, although less desirable, even a rubber locking member can be adapted to work. The locking member 46 terminates in an enlarged or stop portion 48. When the locking member has been threaded to the extent that the enlarged portion 48 is adjacent the cover mounting member 28, further threading is prevented. This is due to the enlarged portion 48 having greater dimensions than the cross-sectional dimensions of the access bore 40. In the preferred embodiment, the channel 38 extends around the entire circumference of the cover member 16. However, in most cases, it has been found that to provide sufficient locking engagement, the channel 38, and therefore the locking member 46, needs to extend around only a portion of the circumference, such as one-third of the distance. In such a case, the rim 22 needs to have a curved contour only for that portion having the channel 38. On the other hand, if extraordinary locking strength is required, it will be obvious to those skilled in the art that the channel 38 can encircle at least portions of the rim more than once when the channel 38, and therefore the grooves 24 and 36, take a helical configuration.

A pair of handles 50 and 52 are mounted on opposed sides of the cover member 16 to assist in removing the cover member 16 from its sealing engagement with the cover mounting member 28, after the locking member 46 has been removed.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A locking and sealing arrangement for a port light of a floating vessel, comprising:

said port light;

a cover member with an outwardly facing rim having formed thereon a pair of spaced-apart, peripheral grooves, a first groove and a second groove;

a cover mounting member adapted to be secured to said floating vessel in surrounding relationship to said port light;

said cover mounting member having an inwardly facing surface dimensioned and configured to substantially conform to the said outwardly facing rim of said cover member;

at least portions of said inwardly facing surface having dimensions larger than said port light to provide a ledge when said cover mounting member is secured to said floating vehicle;

said inwardly facing surface having a third groove formed therein, said third groove being aligned to be in opposed relationship to said first groove to form a channel when said cover mounting member is in abutting relationship to said ledge;

an access bore extending through said cover mounting member and connecting with said channel;

an elongated and pliable locking member being adapted to be threaded through said access bore into said channel, whereby said pliable member spans the juncture of said cover member and said cover mounting member; and a resilient sealing gasket being mounted in said second groove, whereby said gasket forms a substantially water-tight seal with said inwardly facing surface of said cover mounting member;

said cover mounting member being formed of a plastic;

said cover member being formed of a transparent plastic material;

said cover member having at least one handle mounted thereon for disengaging said cover member from said cover mounting member;

said locking member terminating at one end with an enlarged portion, said enlarged portion having dimensions greater than the cross-sectional dimensions of said access bore.

2. The locking and sealing arrangement according to claim 1, said cover member having a pair of opposed flat surfaces terminating with said rim.

3. The locking and sealing arrangement according to claim 2, said rim having a continuous curvature, whereby said locking member can be threaded without obstruction.

4. The locking and sealing arrangement according to claim 3, a pair of said handles being oppositely disposed on one of said flat surfaces.

* * * * *